US006450444B1

(12) United States Patent
Sorvino

(10) Patent No.: US 6,450,444 B1
(45) Date of Patent: Sep. 17, 2002

(54) FIN LOCK SYSTEM

(75) Inventor: Alfred Sorvino, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/631,149

(22) Filed: Aug. 2, 2000

(51) Int. Cl.[7] ..... F42B 10/06
(52) U.S. Cl. ..... 244/3.24
(58) Field of Search ..... 244/3.24, 3.27, 244/3.28, 3.29, 3.25, 3.26

(56) References Cited

U.S. PATENT DOCUMENTS 4,860,969 A * 8/1989 Muller et al.
5,004,186 A * 4/1991 Hans et al.

FOREIGN PATENT DOCUMENTS

CA 1055003 * 5/1979 ..... 244/3.24

* cited by examiner

*Primary Examiner*—Charles T. Jordan
*Assistant Examiner*—T. Dinh
(74) *Attorney, Agent, or Firm*—William J. Benman; Colin M. Raufer; Glenn H. Lenzen, Jr.

(57) ABSTRACT

A fin lock device (12) for a missile. The device (12) provides a mechanism for locking a missile fin (14) by grasping an edge of the fin (14) and a mechanism (32, 42) for retracting the locking mechanism (18) to release the fin (14). The fin (14) is grasped by a notch (20) therein adapted to receive the edge of the fin (14). The piston (18) is retracted by burning a pyrotechnic powder in a cavity adjacent to the piston (18) to fill the cavity with gas and create a pressure differential to force the piston (18) away from the fin.

7 Claims, 2 Drawing Sheets

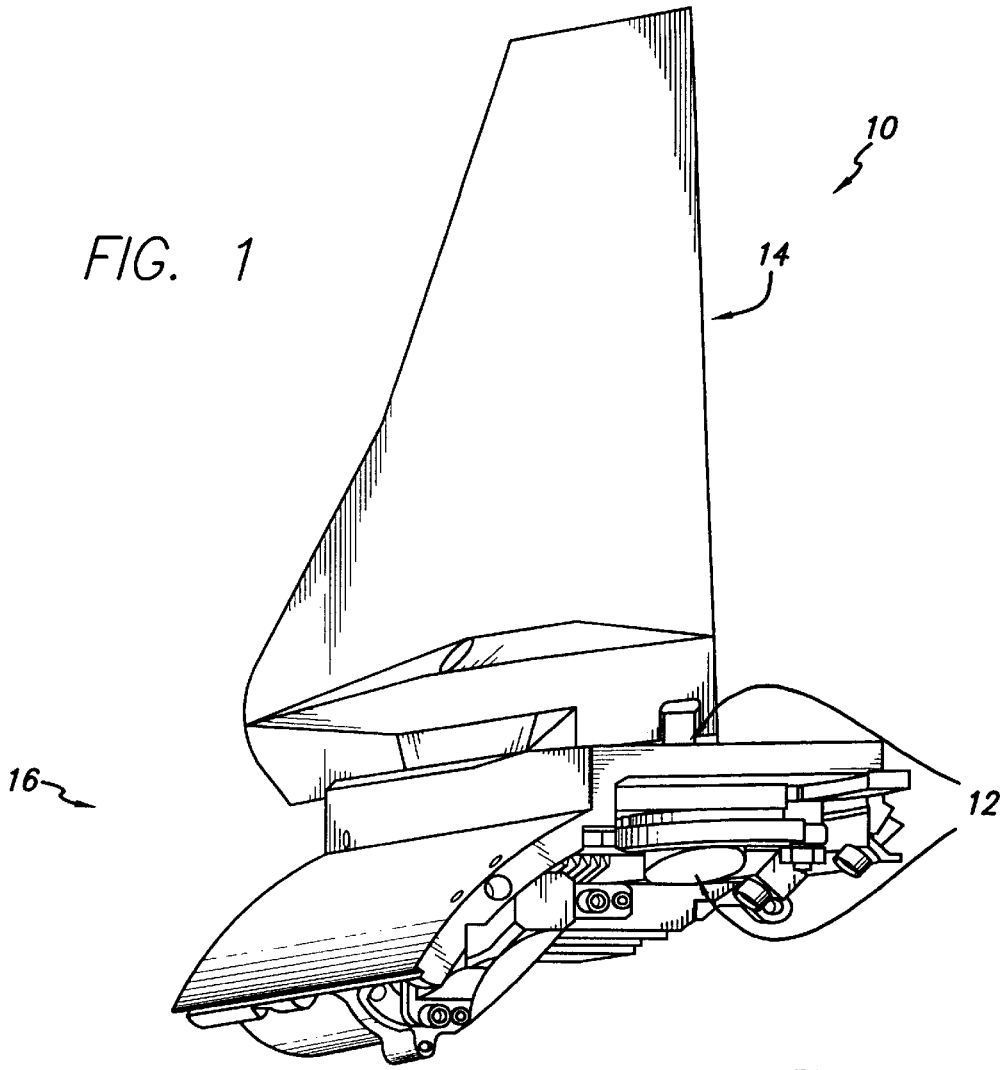
FIG. 1
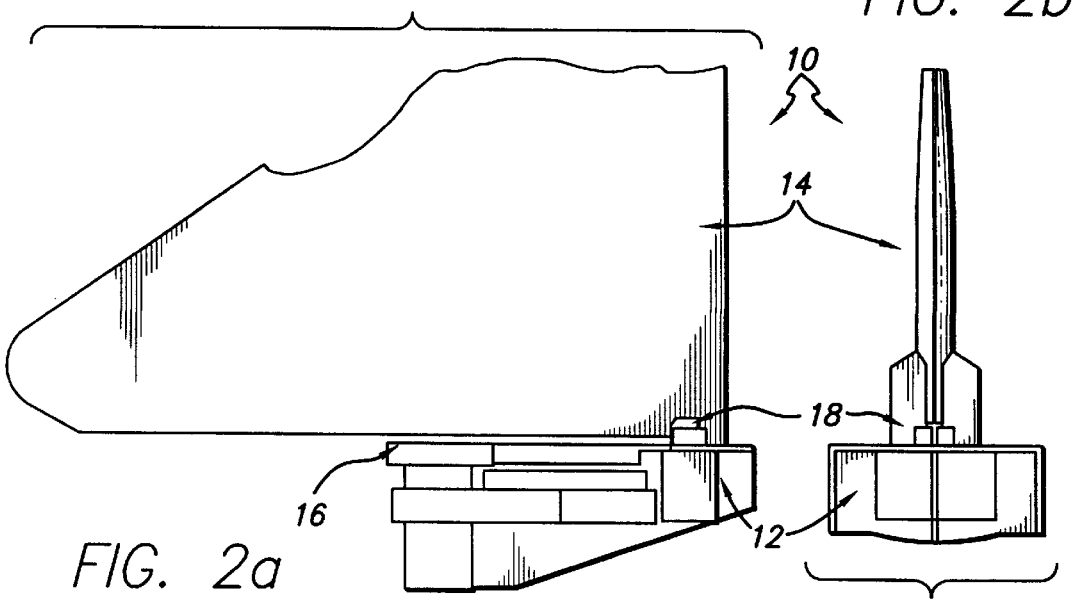
FIG. 2b
FIG. 2a

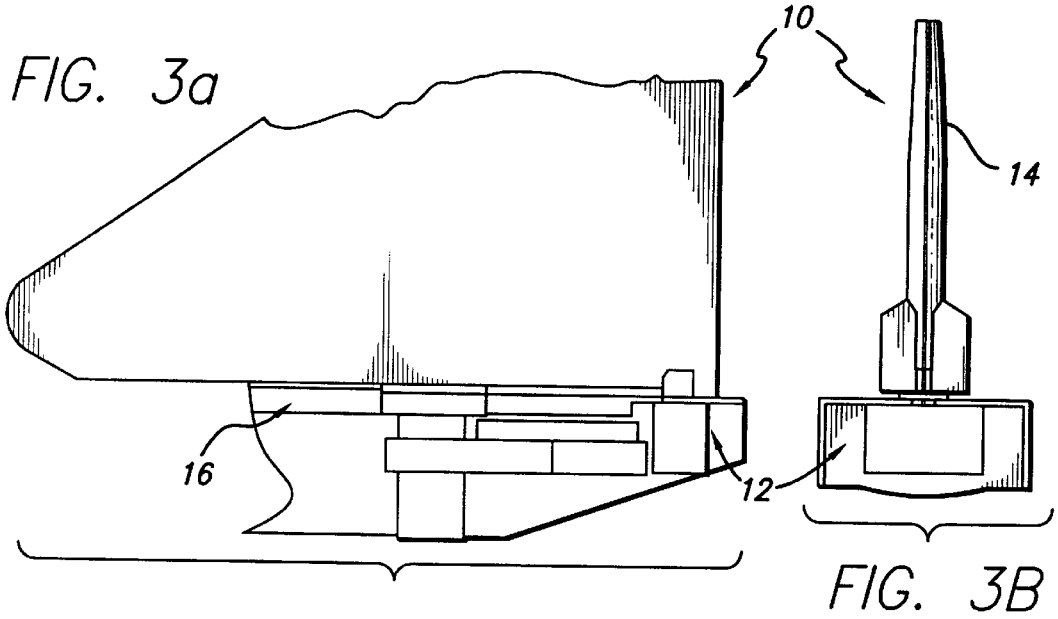
FIG. 3a
FIG. 3B
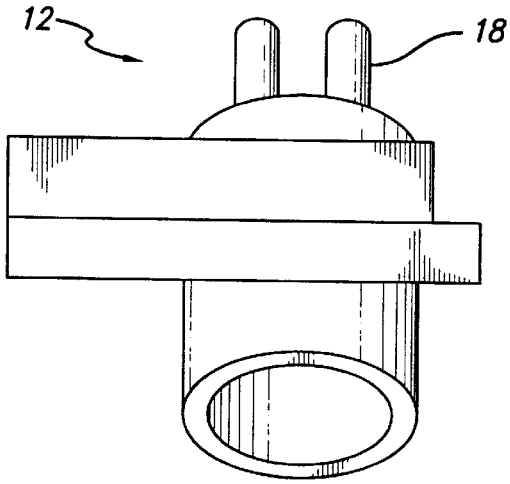
FIG. 4
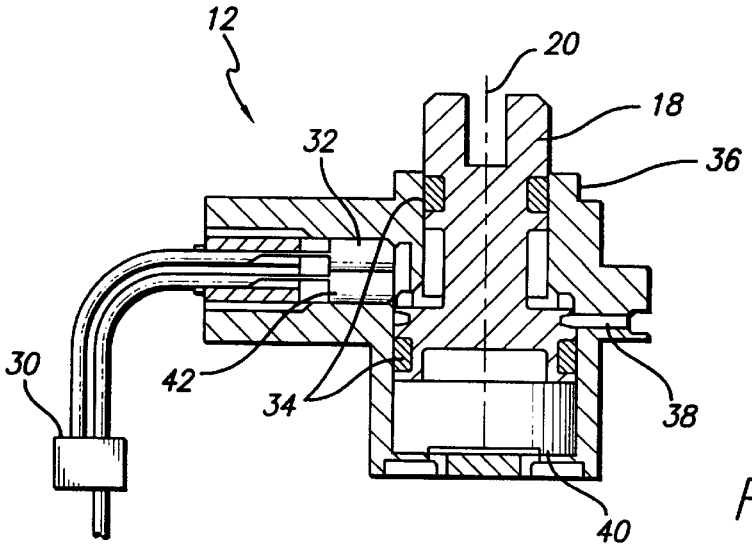
FIG. 5

FIN LOCK SYSTEM

BACKGROUND OF THE INVENTION

1. Field of Invention:

This invention relates to missiles. Specifically, the present invention relates to fin lock systems for missiles.

2. Description of the Related Art:

Typically, the fins of a missile must be locked during transportation on an aircraft or other launch vehicle. However, at launch time, they must be quickly unlocked to be ready for missile flight. For example, a missile carried on an F-16 aircraft has its fins locked prior to launch. When the pilot is ready to fire the missile, a signal is sent from the cockpit which starts the missile's battery. When the cockpit has confirmation that the missile is powered, it signals the missile's fins to unlock and wiggle to verify function. When fin release and function is confirmed, the cockpit signals the missile launcher to unlock and launch the missile.

In a combat situation, where time is critical, it is essential that the fins unlock as quickly as possible. However, the small diameter (typically 5 inches) of many missiles has been an impediment to designing a fin lock system for quick release.

Prior approaches include a complicated system employing a gas generator. To effect fin release, this prior system collects gas and distributes it through a manifold to each fin piston, which compresses to release the fin. This system has many parts and is slow, taking on the order of 70 milliseconds to unlock the fins. Also, it is difficult to maintain the pressure in the one large reservoir because of gas leaks. Accidental firings are a problem with this system, and it cannot be reused because of contamination.

Another prior approach utilizes a shear pin which fractures to unlock the fins. This system requires a high energy input from an electric motor. It is also prone to failure and debris contamination. Exploding bolts have also been used, but these suffer from contamination problems as well.

Thus, a need remains in the art for a less complex, more reliable system which can lock the fins of a small diameter missile yet quickly unlock them for launch.

SUMMARY OF THE INVENTION

The need in the art is addressed by the present invention which provides a fin lock device for a missile. The device provides a mechanism for locking a missile fin by grasping an edge of the fin and means for retracting the locking means to release the fin.

In a specific embodiment, the fin is grasped by a piston having a notch therein for receiving the fin edge. The piston is retracted to release the fin by burning a pyrotechnic powder in a cavity adjacent to the piston to fill the cavity with gas and create a pressure differential to force the piston away from the fin.

BRIEF DESCRIPTION OF THE DRAWINGS

FIG. 1 is a perspective view of a missile quadrant employing the fin lock system of the present invention.

FIGS. 2*a* and 2*b* depict side and end views, respectively, of the missile quadrant with the fin lock system of the present invention in the locked position.

FIGS. 3*a* and 3*b* depict side and end views, respectively, of the missile quadrant with the fin lock system of the present invention in the unlocked position.

FIG. 4 is an end view of the fin lock system of the present invention.

FIG. 5 is a cutaway end view of the fin lock system of the present invention.

DESCRIPTION OF THE INVENTION

An illustrative embodiment will now be described with reference to the accompanying drawings to disclose the advantageous teachings of the present invention.

The invention is a single fin locking device for a single fin release. The piston in the device protrudes from the airframe and holds the fin securely in place until the device receives a firing pulse and the piston releases the fin. The design has only one moving part, the piston, and operates reliably to release the fin much faster than any known device.

FIG. 1 shows a quadrant 10 of a small-diameter missile (not shown). The missile has plural fins of which only one fin 14 is shown in FIG. 1. Each fin is attached to the airframe 16 of the missile. In accordance with the present teachings, the fin 14 is secured against movement by an inventive fin lock device 12. The fin lock device 12 protrudes through the airframe 16 as depicted in FIG. 1.

FIGS. 2*a* and 2*b* depict side and end views, respectively, of the missile quadrant 10 with the fin 14 in a locked position. The piston 18 of the fin lock device 12 is extended through the airframe 16, holding the outer surface of the fin 14 in a locked position at its inboard aft end. In this configuration, the fin 14 is secured for transportation on its launcher.

FIGS. 3*a* and 3*b* depict side and end views, respectively, of the missile quadrant 10 with the fin 14 in an unlocked position. The piston 18 is not visible, having been retracted through the airframe 16 to release the fin 14. In this configuration, the missile is ready for fin function check and subsequent launch.

FIG. 4 shows an end view of the fin lock device 12 of the present invention. The piston 18 is extended in the locked position. On a typical small-diameter missile having four fins, a device 12 would be disposed to lock each fin, for a total of four independent fin lock devices. The devices are readily installed, requiring only a 4 screw mechanical connection (not shown) and a 2-pin electrical connection (not shown).

FIG. 5 is a cutaway end view of an exemplary embodiment of the fin lock device 12 of the present invention. In the illustrative embodiment, the piston 18 is made of steel or other suitable material. The piston 20 has a notch 20 at the upper end thereof adapted to engage the fin 14 of FIG. 1. The piston 18 is shown in FIG. 5 in the fin locked position and sits in a housing 36 made of steel or other suitable material.

To unlock the fin, a release signal is sent through the 2-pin connector 30 in a conventional manner. The signal causes initiator 32 to ignite a fast-burning pyrotechnic powder, such as gunpowder, in the initiation chamber 42. As the powder burns, the initiation chamber 42 fills with gas, and the expansion of the gas forces the piston 18 to move down into deployment chamber 40 due to a pressure differential. When the piston 18 has moved to the bottom of deployment chamber 40, it no longer protrudes through the airframe. The fin is thus rapidly unlocked and ready to function.

A further advantage of the inventive system is that the device is completely sealed by O-rings 34, which hold the piston down and prevent any contaminants from exiting the device. The sealed system also has a longer shelf life as rust and corrosive elements cannot enter during storage. In addition, a steel shear pin 38 (rated to forty pounds in the preferred embodiment) holds the piston in the locked position prior to firing, preventing accidental fin release, but is readily sheared through when the device is actuated.

The present invention thus has many advantages over the known art. It is more reliable and much less complex, having only one moving part. Because it employs a smaller chamber that fills more quickly, the device operates much faster than prior systems. The sealed system prevents contamination and allows for reuse.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A fin lock device for a missile, comprising:

means for locking a missile fin by grasping an edge of said fin and means for retracting said locking means to release said fin, said retracting means comprising means for creating a pressure differential to force said piston away from said fin.

2. The invention of claim 1 wherein said locking means comprise a piston having a notch therein for receiving said fin edge.

3. The invention of claim 1 wherein said means for creating a pressure differential comprise means for filling a cavity adjacent to said piston with gas.

4. The invention of claim 3 wherein said means for creating a pressure differential comprise means for burning a pyrotechnic powder in said cavity.

5. A fin lock device for a missile, comprising:

means for locking a missile fin by grasping an edge of said fin, said means comprising a piston having a notch therein for receiving said fin edge and means for retracting said locking means to release said fin, said means comprising means for burning a pyrotechnic powder in a cavity adjacent to said piston to fill said cavity with gas and create a pressure differential to force said piston away from said fin.

6. A method for locking a missile fin, comprising:

locking a missile fin by grasping an edge of said fin and retracting said locking means to release said fin, said retraction step comprising burning a pyrotechnic powder in a cavity adjacent to said piston to fill said cavity with gas and create a pressure differential to force said piston away from said fin.

7. The method of claim 6 wherein said locking step comprises grasping said fin edge with a piston having a notch therein for receiving said edge.

* * * * *